United States Patent [19]

Durand-Texte

[11] Patent Number: 4,491,169

[45] Date of Patent: Jan. 1, 1985

[54] APPARATUS FOR THE CONTINUOUS CASTING OF PRODUCTS ESPECIALLY OF METALS, SUCH AS COPPER ALLOYS

[75] Inventor: Gérard Durand-Texte, Paris, France

[73] Assignee: Etablissments Griset, Aubervilliers, France

[21] Appl. No.: 437,259

[22] Filed: Oct. 28, 1982

[30] Foreign Application Priority Data

Oct. 30, 1981 [FR] France ..... 81 20461
Oct. 5, 1982 [FR] France ..... 82 16700

[51] Int. Cl.[3] ..... B22D 11/00

[52] U.S. Cl. ..... 164/418; 164/435; 164/440

[58] Field of Search ..... 164/435, 436, 418, 440, 164/459, 490, 491

[56] References Cited

U.S. PATENT DOCUMENTS 2,871,530 2/1959 Wieland ..... 164/435
3,599,706 8/1971 Wieland ..... 164/435

FOREIGN PATENT DOCUMENTS 2615228 10/1976 Fed. Rep. of Germany ..... 164/418
1527304 4/1968 France ..... 164/418

*Primary Examiner*—Nicholas P. Godici
*Assistant Examiner*—Maureen Weikert
*Attorney, Agent, or Firm*—Louis Orenbuch; John Welch

[57] ABSTRACT

The invention concerns the continuous casting of metals such as alloys of copper and is directed to the type of apparatus that uses a graphite die having a mold passage in which the casting is shaped as it passes through the die. In that type of apparatus, the die is disposed between cooling elements that conduct heat away from the die to cause the hot metal to cool as it passes through the die and because the die has a tendency to bend away from the cooling elements, the apparatus employs clamps to inhibit separation of the die from the cooling elements. In the invention, means are provided to apply compressive force to the ends of the die to cause bending moments to be set up in the die that counteract the tendency of the die to bend away from the cooling elements. In the invention the die is made of two graphite plates of uniform thickness separated by graphite spacers which form a generally rectangular mold passaage. In one embodiment of the invention, compressive force is exerted against the ends of the plate on that side of the plate's neutral plane which sets up bending moments that counteract the forces tending to bend the plate away from its cooling element. In another embodiment of the invention, the plate is initially positioned against a concave surface of its cooling element and compressive forces are applied to the ends of the plate to keep the plate in contact with the cooling elements's concave surface.

4 Claims, 21 Drawing Figures

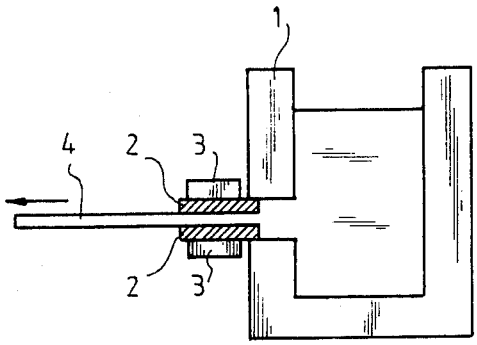
PRIOR ART
FIG. 1
PRIOR ART
FIG. 2
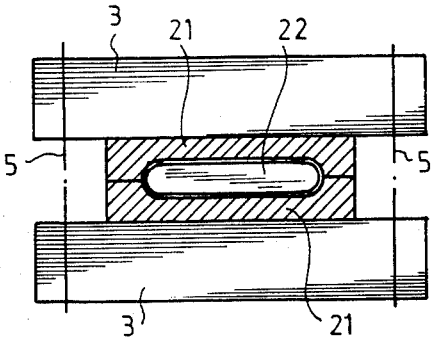
PRIOR ART
FIG. 3
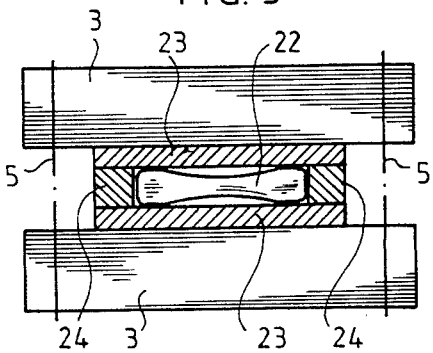
FIG. 4 PRIOR ART
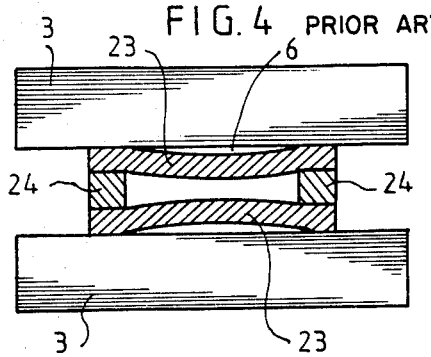
FIG. 5
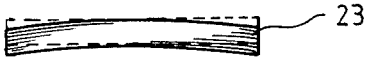
FIG. 6A
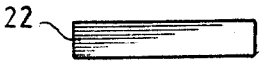
FIG. 6B
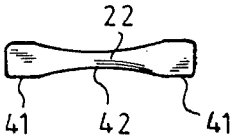

APPARATUS FOR THE CONTINUOUS CASTING OF PRODUCTS ESPECIALLY OF METALS, SUCH AS COPPER ALLOYS

The invention concerns an apparatus for the continuous casting of products, especially of metals such as copper alloys.

It is known to continuously cast metals, and especially copper alloys, with the assistance of apparatus (FIG. 1) employing a crucible 1 containing the metal in the molten state. The crucible 1 has a casting orifice opening into a graphite die 2, of for example rectangular cross-section, which is cooled by cooling elements 3, for example by circulation of a cooling fluid. The hot metal, which is progressively cooled in the die 2 by the elements 3, can then be drawn in the form of a ribbon 4.

The speed of operation of such apparatus depends on the capability to cool the assembly formed by the die 2 and the elements 3. Thus, the ribbon 4 may only be drawn if it displays sufficient resistance, in other words when it has been sufficiently cooled.

Two types of die (FIGS. 2, 3) are generally used. The first type of die consists of two half-shells of graphite 21—21 machined to form the mold passage 22 which shapes the metal ribbon emerging from the die. The two half-dies 21 are held between the cooling elements 3, which are fixed to one another by tie-bars or assembly means 5.

Apart from the disadvantages discussed below, this arrangement requires an expensive machining process for the die.

The second type of die used at present (FIG. 3) consists of two plates 23, separated by spacer elements 24, in such a way as to form the passage 22 for the metal. The assembly thus formed is, held between two cooling elements 3 connected together by tie-bars 5.

This arrangement is more advantageous than the preceding one, because it is not necessary to machine dies of a relatively complex shape from graphite.

As the speed of operation of the casting process depends on the rate of heat transfer from to the die to the elements 3, it is essential that the surfaces of the dies 21, 23 and of the cooling elements 3 be in as good contact as possible.

Unfortunately (FIG. 4) the elements 23 (or 21) of the die tend to bend (FIG. 4). This bending is essentially caused by the expansion resulting from the temperature gradient inside the graphite elements.

Now, as a result of this bowed shape, the die elements 23 (or 21) become detached from the cooling elements 3 to form an air gap 6. This air gap 6 reduces, by a substantial amount, the efficiency of the heat transfer and, therefore, the speed of operation of the apparatus.

Referring to FIG. 5, one solution which has been proposed is to form elements 23 (21) with a curvature opposite to that shown in FIG. 4. Once in use, these elements 23 should lie flat against the elements 3. Now, apart from the fact that this solution is extremely difficult to achieve because of the delicate machining of the die elements 23 required to obtain the appropriate curvature, this solution does not give the expected results.

It is known to fix the elements 23 against the elements 3 by gluing, or better, by means of screws. Now this latter solution, which allows a more effective bond to be formed than by gluing, nevertheless has serious disadvantages, because it is necessary to machine screwthreads in the graphite elements which, moreover, must be thicker so as not to be fragile. Furthermore, it is necessary to pierce the elements 3 for the passage of the threaded tie-rods. Assembly and disassembly consequently become more complicated and time-consuming.

Another problem connected with continuous casting is contraction of the casting. Thus, with a die having a cross-section corresponding to FIG. 6*a*, a ribbon is obtained whose cross-section is like that of FIG. 6*b* (in this figure, the concavity in the central part has been greatly exaggerated).

The edges 41, 41 of the ribbon 4 correspond to the shape of the die while, in the middle of this cross-section, the surfaces 42, 42 are concave; this results from the temperature difference between the edges of the ribbon and the centre. This concavity effect becomes accentuated in a cumulative manner, in part, because the heat exchange properties of the graphite die is poorest towards the centre, as a result of the relatively poor contact with the cooling elements and, in part, because of the narrowing of the die passage 22 due to the deformation of the die elements (See FIG. 4).

An object of the present invention is to remedy these disadvantages by providing a continuous casting die, especially for the casting of a copper alloy, which permits casting of ribbons of uniform thickness, at a high casting rate.

For this purpose, the invention is directed to continuous casting apparatus, having means which create bending moments which force the parts of the die against the corresponding faces of the cooling elements. More particularly, the invention pertains to an arrangement for exerting compressive forces beneath the neutral plane transverse to the die to force, by reaction, the die elements into surface-to-surface contact with the cooling elements over the whole of the area available for contact.

Owing to the lateral pre-stressing of the parts of the continuous casting die, tendency of the die to bend away from the cooling elements is counteracted and consequently these parts of the die maintain contact with the cooling elements and thus ensure effective cooling of the elements of the die.

According to another characteristic of the invention, the contact surfaces of the cooling elements are concavely curved.

By thus forming the cooling elements in a slightly curved shape, the contact between the parts of the die and the cooling elements is further improved and the bowtie shape of the ribbon is compensated for.

This solution gives no particular problems, because the parts subject to wear are the elements which form the die, and the cooling elements are not subjected to any wear.

Now, the elements of the die are always formed by flat elements, which are easily submitted to lateral forces.

According to another characteristic of the invention, the concave surfaces of the cooling elements are formed by assemblies of elemental surfaces separated by recessed parts which are easily submitted to lateral forces.

According to another characteristic of the invention, the concave surfaces of the cooling elements are formed by assemblies of elemental surfaces separated by recessed parts which form channels for a heat exchange fluid.

The distribution of the forces in the interior of the flat elements which constitue the die is improved by applying pressure at three points. This solution also has the advantage of simplifying the manufacture of the cooling element, because the three contact surfaces are flat surfaces.

The present invention will be described in more details with the assistance of the attached drawings in which:

FIG. 1 is a schematic sectional view of conventional apparatus for continuously casting a copper alloy;

FIG. 2 is a cross-sectional view of a graphite die theretofore used in continuous casting;

FIG. 3 is a cross-sectional view of another form of casting die according to the prior art;

FIG. 4 illustrates the deformation of the die elements caused by thermal stresses;

FIG. 5 is a cross-sectional view of one form of a die element which is inversely curved;

FIG. 6A, represent respectively a theoretical of a ribbon formed by continuous casting;

FIG. 6B represents the cross-section of the ribbon product actually obtained, the deformation having been exaggerated;

Figure 7:
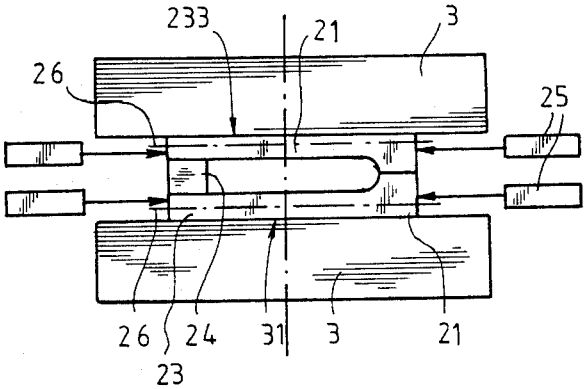
FIG. 7 is a schematic view of two forms of apparatus, one to the right of the centerline and the other to the left of the centerline.

Referring now to FIG. 7, the apparatus of the invention which is shown in a schematic sectional view at the level of the die, consists of cooling elements 3, which are forced against the parts 23 of the die, the parts 23 being themselves separated by spacer elements 24 so as to define a die, for example of rectangular cross-section. The apparatus includes means which permit flexing moments to be exerted, for example compression means 25 acting on the edges of the parts of the die in order to exert compressive effects F, on the side opposite to that of the cooling elements 3, with reference to the plane 26 of the neutral fibre in each part of the die 23.

Figure 8:
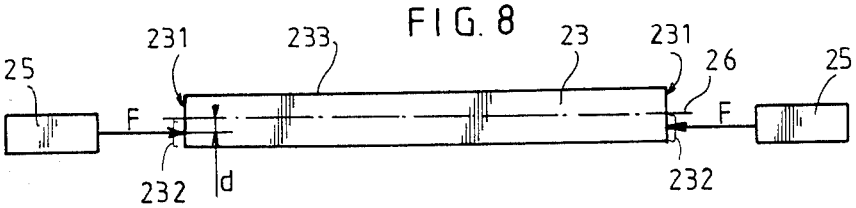
FIGS. 8, 9 and 10 are explanatory diagrams relating to the structures shown in FIG. 7.

FIG. 8 shows the action of compressive forces on of the die.

Figure 9:
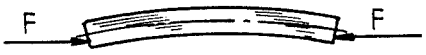

In that figure, the arrows represent the resultant F of the compressive forces exerted on the lateral faces 231 of the die plate in the areas 232. From FIG. 8 it can be discerned that the areas 232 are situated with respect to the neutral plane 26, on the side opposite to the face 233 which is to be held in contact with the surface of its cooling element 23. The distance d between the neutral plane and the line of the resultant F allows the moment $M=F\times d$ exerted on the part 23 to be calculated and tending to cause bending of this part 23 as shown in FIG. 9.

Figure 10:
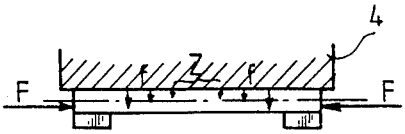

As (FIG. 10) the cooling element 3 opposes the bending of the part 23, the forces fi being distributed, at a distance di from each spacer element 24 forming a support are such that $$M=\Sigma Mi \text{ or } F\times d=\Sigma fi\times di$$

Now, the calculation shows that the forces fi (or the corresponding reactions) decrease as di increases and that a median zone exists in which the forces are nil.

Figure 11:
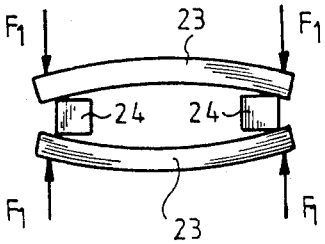
FIG. 11 is a diagrammatic representation of another means of producing a bending moment.

FIG. 11 shows how to create bending moments by exerting forces $F_1$ on the ends of the parts of the die 23, situated beyond spacer element 24.

Figure 12A:
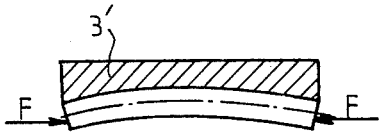
FIG. 12 shows another embodiment of the invention.
Figure 12B:
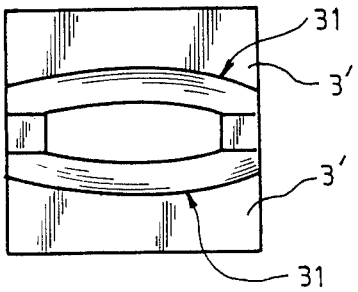

According to FIG. 12, a first solution in order to arrive at a better distribution of forces and, consequently, a better application of the part 23 against the cooling element, is to provide a concavely curved element 3'.

FIG. 12 shows a complete die with two concave parts 3'.

Figure 13:
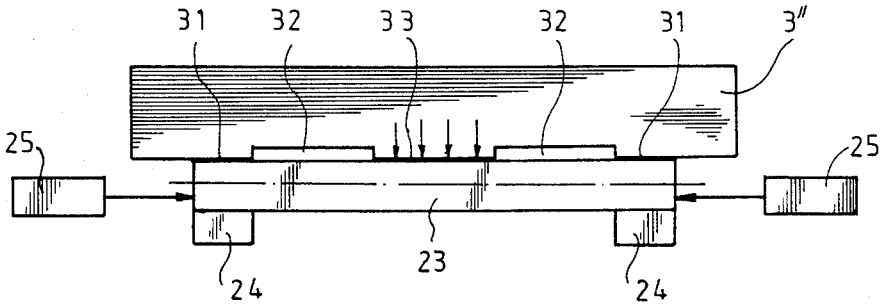
FIG. 13 is a schematic diagram of another variant of the invention.
Figure 14:
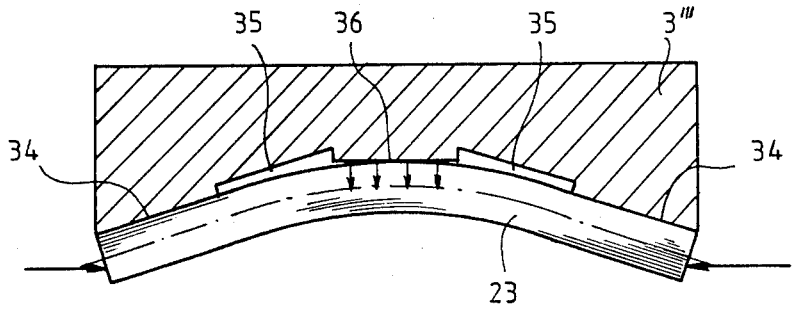
FIGS. 14, 15 shows two embodiments of a variant according to FIG. 13.
Figure 15:
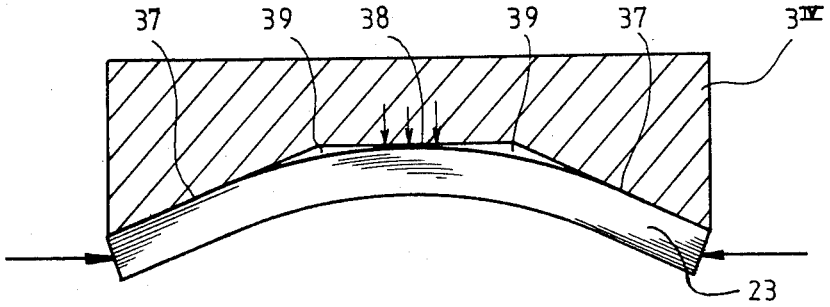

Another solution to differently distribute the forces is shown in FIGS. 13, 14, 15.

According to FIG. 13, the cooling element 3'' has a supporting surface for the part 23 which comprises lateral zones 31 to press on the part 23 to the right of the spacer element 24, a central zone 33, and intermediate cavities 32.

Under these conditions, the forces fi (or the reactions) are mainly exerted only in the zone 33, which is a guarantee of good contact between the pieces 23 and 3'', while no contact is possible other than in the zones 31, 33, 31.

The cavities 32 can receive a heat-conductive fluid such as hydrogen or helium or mercury.

FIG. 14 shows a variation of FIG. 13 in the case of a cooling element 3''' having a concave contact surface. This surface includes pressure zones 34, 36, 34 at the edges and at the middle as well as cavities 35 filled with a conductive fluid (hydrogen, helium, mercury).

This solution combines the advantages of pressure zones and the concave surface.

FIG. 15 shows a particularly advantageous embodiment.

Thus, the cooling element $3^{IV}$ has a concave surface obtained by three straight sections 37, 38, 37. As the part 23, subjected to compressive efforts, adopts a continuously curved form, cavities 39 remain between the polygonal shape 37, 38, 37 and the continuously curved shape of the part 23.

As above, these cavities 39 can receive a heat-conductive fluid.

This latter solution is particularly advantageous in its manufacture and use. Its manufacture is simple because it is sufficient to make in put $3^{IV}$ a cavity having a polygonal cross-section (of which the number of segments is not limited to three).

The efficiency of this solution is also very great as a result of the combination of pressure zones and the conical shape of the cavity.

Furthermore, the concave surface forces of the cooling elements and, consequently of the die parts, permit the bowtie form of the ribbon to be compensated for by increasing the thickness at the ribbon's center. In a general manner and as a variant of FIG. 11, the bending moments created by the compressive forces exerted on the outside of spacer elements 24 may for example be obtained by the positioning of wedges between the ends of the parts of the die 21, 23 and the corresponding surface of the elements 3, beyond the spacer elements 4, by exerting a tractive force by means of the tie-rods 5.

Figure 16:
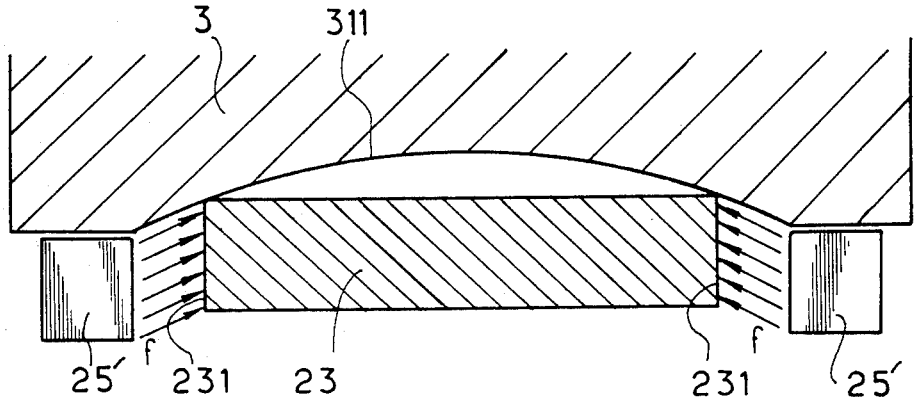
FIG. 16 is a schematic view of the upper half of an embodiment of the invention employing a cooling element having a concavity facing the die plate.
Figure 17:
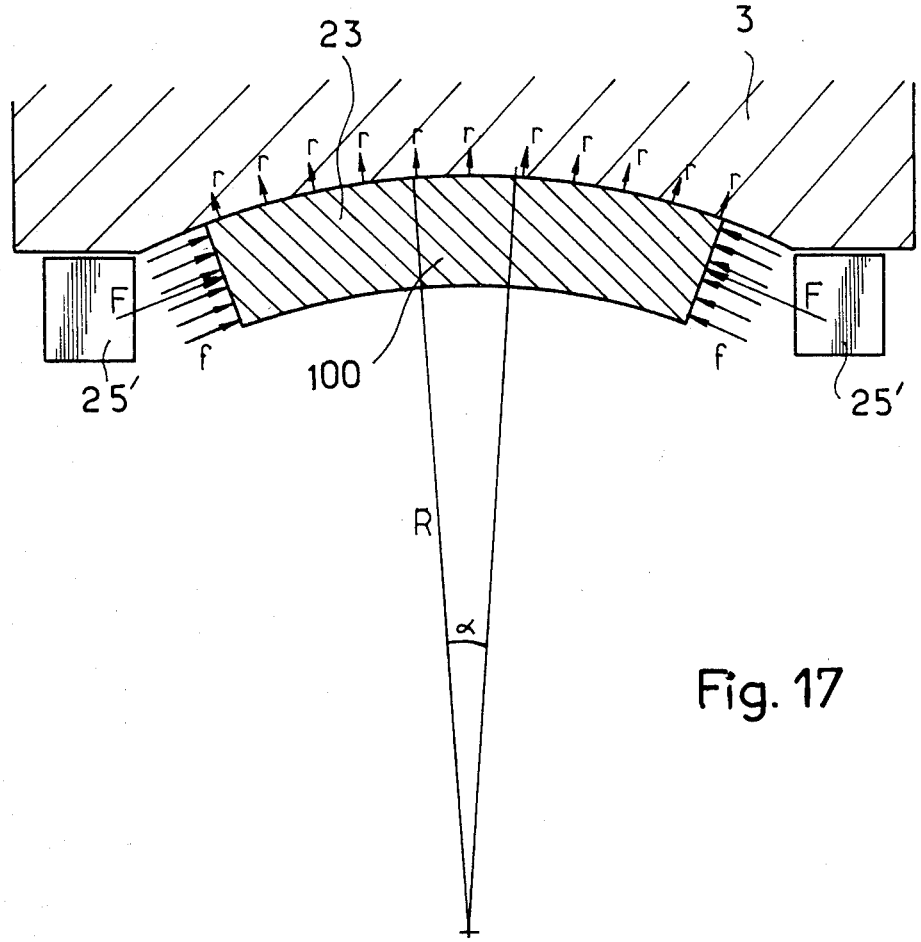
FIG. 17 shows the forcing of the die plate against the concave surface of the cooling element by the application of compressive forces on the ends of the plate.

According to FIGS. 16 and 17, the continuous casting apparatus of which only a part is shown, consists of a cooling element 3 of which the surface 3'' against which is to be applied the die part 23, is curved. This surface 3'' can, in other cases, be flat.

The die part 23 is submitted to the action of means 25' which create a bending moment in this die part in order to apply it against the surface 3'' (FIG. 17). These means 25' exert distributed forces f inclined in the direction of the surface 311, that is to say forces having a component distributed and directed toward the face 311.

The forces exerted by the means 25' are distributed over the whole of the lateral surface 231 and the die part 23.

Figure 18:
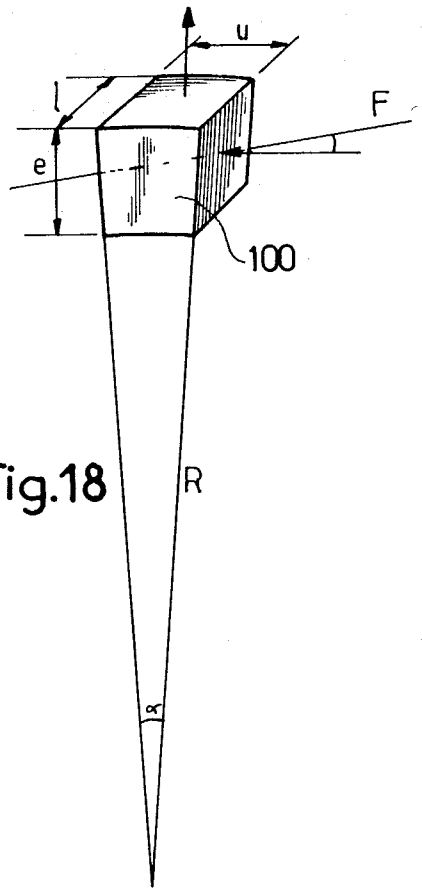
FIG. 18 is a schematic diagram of a sector of part of the die used to calculate the forces in operation in the example of FIGS. 15 and 16.

FIG. 18 permits the calculation of the reaction RE of an element of the die part 100 on the cooling element 3 to be explained as a function of the forces F resulting from the distributed forces f applied against the surfaces of the extremity 231 of the die part 23. When:

e = the thickness of the die part 23, l = the width of the die part 23, u = the length of the element of the die part 23, f = the surface over which the element of the die part 23 is forced against the cooling element 3, F = the resultant force of the distributed forces f.

$s = l \times u;\ F = f \times e\ c\ i;$

R is the radius of curvature of the cooling element 3 and the die part 23.

$\alpha$ is the angle which the element 100 of the die part 23 subtends at the center of curvature ($\alpha = u/R$) (1).

The two forces F are made up, and give a vertical reaction RE, such that:

$$RE = F\alpha = (2)Fu/R = f\ e\ i\ u/R$$

where $$r = (RE)/(ul) = (f\ e)/R$$

Figure 19:
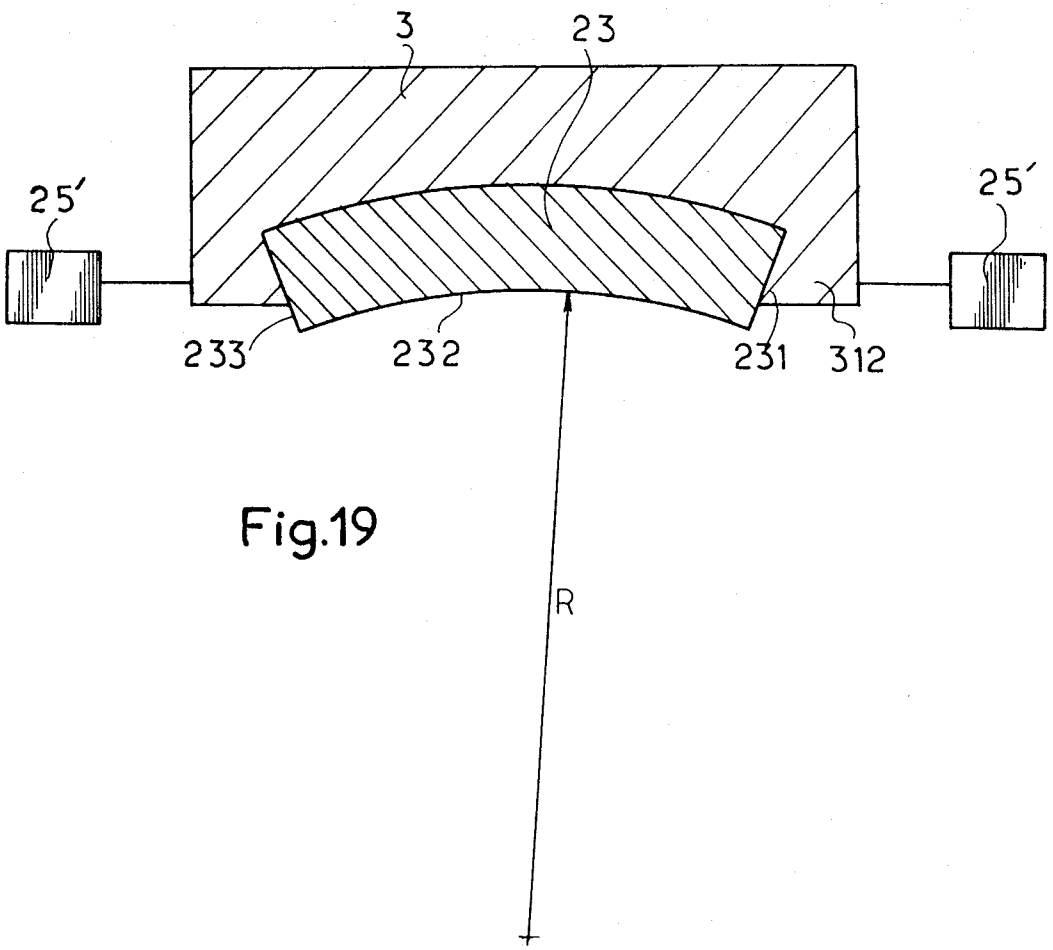
FIG. 19 is a diagrammatic view of another embodiment of the invention.

FIG. 19 shows another embodiment. The die part 23 is held inside the corresponding cooling element 3 which is composed of lateral portions 312 which define a recess to receive the die part 23. The lower surface of the die part 23 can be curved as shown by reference 232 or planar by reference 233.

On each side of FIG. 19, there is schematically shown the means 25 which exert a bending couple on the die part 23, that is to say a lateral force distributed over the whole of the surface of virtually the whole of the lateral surface 231 of the die part 23.

According to another variant which is not illustrated, the means which create flexing moments are means which permit the injection of a component which reacts with at least one part of the layer over a particular depth in order to cause elongation of this layer and consquently a moment which can cause flexing of the die part.

I claim:

1. In apparatus for continuously casting metals such as alloys of copper, the apparatus being of the type having (1) a graphite die providing a passage therethrough which shapes the emergent casting, the die being in at least two parts, (2) cooling elements for conducting heat away from the die, the die being disposed between the cooling elements, and (3) means for maintaining the die in surface to surface contact with the cooling elements to promote heat conduction from the die to the cooling elements during metal casting, the improvement wherein (a) each of said at least two parts of the graphite die comprises a plate of uniform wall thickness, and (b) the means for maintaining surface to surface contact is arranged to apply compressive forces to areas of the lateral surface of the plate, said forces being applied only on the side of the neutral plane farthest from the die surface in contact with the cooling element.

2. The improvement according to claim 1, wherein (c) each of said cooling elements has a concave surface for making surface to surface contact with the facing surface of the die.

3. In apparatus for continuously casting metals such as alloys of copper, the apparatus being of the type having (1) a graphite die providing a passage therethrough which shapes the emergent casting, the die being in at least two parts, (2) cooling elements for conducting heat away from the die, the die being disposed between the cooling elements, and (3) means for maintaining the die in surface to surface contact with the cooling elements to promote heat conduction from the die to the cooling elements during metal casting, the improvement wherein (a) each of said at least two parts of the die is a plate of uniform wall thickness, (b) each of said cooling elements has a concave surface for making surface to surface contact with the facing surface of the die, and (c) the means for maintaining surface to surface contact is arranged to apply compressive force to the lateral surfaces of the plate in a manner causing a component of that force to be directed toward the interface between the plate and its cooling element.

4. The improvement according to claim 3, wherein at least one of the cooling elements has a cavity in which its associated die part is received, the cooling element enveloping at least a portion of the peripheral lateral surfaces of the associated die part and enabling compressive force to be exerted thereon.

* * * * *